US005919095A

United States Patent [19]

Risner

[11] Patent Number: 5,919,095

[45] Date of Patent: Jul. 6, 1999

[54] ANGLED POOL TABLE RAIL-MIRROR

[76] Inventor: Ron K. Risner, 5474 Benton Rd., Jackson, Mich. 49201

[21] Appl. No.: 09/071,901

[22] Filed: May 4, 1998

Related U.S. Application Data

[60] Provisional application No. 60/049,767, Jun. 16, 1997.

[51] Int. Cl.[6] ..... A63D 15/00

[52] U.S. Cl. ..... 473/46

[58] Field of Search ..... 473/2, 31, 46

[56] References Cited

U.S. PATENT DOCUMENTS

| | | | |
|---|---|---|---|
| 1,074,279 | 9/1913 | Medvec | 473/32 |
| 1,297,815 | 3/1919 | Englehart | 473/2 |
| 3,463,593 | 8/1969 | Horan . | |
| 3,917,264 | 11/1975 | Davidson | 473/46 |
| 4,027,883 | 6/1977 | Battori | 473/2 |
| 4,082,270 | 4/1978 | Josenhans . | |
| 4,531,732 | 7/1985 | Harris | 473/46 |
| 4,688,796 | 8/1987 | Wright | 473/46 |

FOREIGN PATENT DOCUMENTS 138249 1/1902 Germany .

*Primary Examiner*—Theatrice Brown
*Attorney, Agent, or Firm*—Richard C. Litman

[57] ABSTRACT

An angled pool table rail-mirror for teaching players how to execute bank shots comprising a reflective surface disposed on a base which fits under the rail cushion of any standard pool table. The mirror is fixedly angled to a position which enables the shooter to line up virtually any bank shot while standing in a natural shooting position. The base of the rail-mirror possesses a knurled surface which secures the device under the rail cushion and prevents it from being inadvertently knocked out of horizontal alignment with the rail.

6 Claims, 3 Drawing Sheets

ANGLED POOL TABLE RAIL-MIRROR

CROSS-REFERENCE TO RELATED APPLICATION

This application claims the benefit of U.S. Provisional Patent Application Ser. No. 60/049,767, filed Jun. 16, 1997.

BACKGROUND OF THE INVENTION

1. FIELD OF THE INVENTION

The present invention relates to the field of games and amusement devices, and more particularly to the field of accessories for table games such as billiards, pool or snooker.

2. DESCRIPTION OF RELATED ART

The table games of pool, billiards and similar games are played by shooting the cue ball with the cue stick and causing it to collide with another ball so as to drive the target ball to a certain location, such as the pocket at the edge of the table. Players often accomplish this objective by causing either the cue ball or the target ball to rebound from a rail cushion in a certain direction. Such shots are known as bank shots. In these shots the player attempts to adjust the angle of incidence of the ball on the cushion so that the angle of rebound will be in the desired direction. If the ball collides elastically with the rail cushion, these angles will be equal. The player will therefore select the location on the rail such that the angle of rebound will be in the direction of the desired target, such as the table pocket. In order to achieve skill at the game, a player must develop the ability to accurately judge these angles. Various learning aids for developing this skill are currently known. These learning aids suffer from two serious drawbacks which cause the aids to be only marginally useful in training a player to judge the impact point viewed from the shooting position.

The first drawback is that the devices are complex and time consuming. For example, use of some shooting aids requires the shooter to walk around the table, position the device, walk back to the shooting position to line up the bank shot, again walk around the table to remove the shooting aid, again return to the shooting position, and finally make the bank shot by estimating the location on the rail of the unmarked impact point, as previously indicated by the device. One such device is disclosed in U.S. Pat. No. 3,463,593 issued to Horan (Cue Ball Angle Computer Including a Curved Mirror for Indicating an Impact Point). A second device is disclosed in U.S. Pat. No. 4,082,270 issued to Josenhans (Billiard Banking Aid).

The second common drawback is that many learning aids must be positioned or adjusted prior to each bank shot. This breaks the shooter's concentration. The previously mentioned Horan and Josenhans devices suffer this drawback. Other devices which require repositioning prior to use include the invention disclosed in German Pat. No. 138,249 issued to Faller (Vorrichtung Zum Erlernen Billiardspiels) and U.S. Pat. No. 4,027,883 issued to Batori (Method for Aiming a Billiards Bank Shot).

To overcome some of these drawbacks, two devices were developed which allow the player to see the shot directly at the time he prepares to shoot and to continue to see it during the entire shooting process. This improvement allows the player to view the entire geometry of the shot from the shooting position both before and after the collisions.

The first such device is disclosed in U.S. Pat. No. 1,297,815 issued to Englehart, which teaches a pool table with mirrors or reflectors located under the rail cushion between the pockets to aid in making bank shots. This device utilizes the optimal principal of equality of the angles of incidence and reflection of rays of light. In making a bank shot, the player can view the target through the mirror, and judge the angle of the bank shot by aiming the ball at the target's reflection. The ball and the target can be kept in view throughout the execution of the shot, so that the player does not have to remember the location of the impact point on the rail cushion. The Englehart device thereby provides advantages over the invention of Horan in assisting a player to develop skill in judging these shots. However, the Englehart patent fails to disclose the use of rail-mirrors which are angled relative to the vertical plane. Thus, the Englehart device suffers from the disadvantage that a player standing at the shooting position would have to bend over the table and assume an unnatural sighting position in order to use the mirror to line up his bank shot. Shooting the cue from this unnatural sighting position is uncomfortable, makes proper execution of the shot more difficult, and, over a period of time, could cause the player to develop a bad shooting posture which would overshadow the benefits of using a rail-mirror learning aid.

The second rail-mirror device is disclosed in U.S. Pat. No. 4,531,732 issued to Harris. To overcome the shortcomings of the Englehart device, the Harris invention incorporated an adjustable rail-mirror. The adjustable rail-mirror disclosed therein is connected to a back plate by a hinge. The rail-mirror can be rotated through a range of angles relative to the vertical plane by adjustment of a small machine screw. The patent further discloses a "cue stick wrench" which is specially designed to fit on a cue stick and is used to engage the machine screw for angular adjustments of the rail-mirror. The mirror is adjustable so that the player can re-adjust the vertical angle of the mirror every time he attempts a bank shot. The patent fails to envision—and does not disclose—that a rail-mirror can be set to one single optimum angle such that once positioned thereto, a shooter standing in a natural sighting position will be able to use the rail-mirror to line up virtually any bank shot on the pool table. This optimum angle is not dependant on a shooter's height because, when shooters lean over to assume a natural shooting position, all shooters' vertical viewing angle of the table is roughly equal. The optimum angle is only dependant on the shooter's distance from the opposing rail. This distance is determined by the width or length of the pool table. Therefore, rail-mirrors can be permanently fixed at predetermined angles. Side-rail-mirrors are fixed to an optimum side-rail-angle, and end-rail-mirrors are fixed to an optimum end-rail-angle. Additionally, angled rail-mirrors with slightly convex surfaces can be used to provide the shooter with an even wider, enhanced viewing range.

The Harris device is overly complex and suffers from various drawbacks. Because the device has movable parts, the mirror is prone to drift and will likely need to be adjusted every time the device is moved from table to table. It also requires periodic adjustments even if moved infrequently. More problems are associated with the cue stick wrench. To use the cue stick wrench, the player must place the wrench on a cue stick tip. Thus, a player would have to re-chalk the cue stick after every use of the wrench. Additionally, cue stick tips vary in diameter, so a player would either have to find a cue stick to match his wrench, or purchase and carry an array of cue stick wrenches. Finally, adjustment of the rail-mirror would be difficult or impossible if the player loses or simply forgets to bring the cue stick wrench. These characteristics of the Harris rail-mirror result in extra effort, increased expense, and decreased portability.

Use of conventional rail-mirror learning aids poses one additional problem. It is beneficial to manufacture the rail-mirror's base from a lightweight material in order to increase the portability of the device. However, lightweight rail-mirrors are more prone to movement. Rail-mirror movement can result from varying causes including vibrations produced by pool balls striking the rail, and by players and passersby inadvertently bumping into the pool table. This creates an additional problem because it is imperative that the rail-mirrors remain under the rail, secure and stationary. If a rail-mirror moves, it can drift out of horizontal alignment with the rail, and the mirror's reflection will indicate an inaccurate banking point on the rail. Even worse, if the rail-mirror moves too far from under the rail, a pool ball can collide into and break the rail-mirror.

None of the existing devices disclose any features to prevent rail-mirror movement. Therefore, a need exists for such improvements. None of the above inventions and patents, taken either singly or in combination, is seen to describe the instant invention as claimed.

SUMMARY OF THE INVENTION

The improved pool table rail-mirror disclosed herein comprises a base and a reflective surface disposed thereupon. The shape of the reflective surface may be selected from a range of vertical profiles, but must possess a horizontal profile which is flat. The vertical profiles may be flat, concave or convex surfaces. The rail-mirror is adapted for fitting under and extending along the rail cushion of a pool table, billiards table or snooker table. The reflective surface is fixedly angled to reflect the view of a target, such as a ball or a pocket, to the sight-line of a player positioned across the pool table from the rail mirror. The angling of the rail-mirror allows the shooter to line up bank shots while standing in a natural shooting position. It is preferable that the base be constructed such that when the rail-mirror is fully inserted under the rail cushion, the length of the reflective surface be in horizontal alignment with the rail cushion and thereby need no horizontal adjustments.

Because the improved rail-mirror is permanently affixed to the base at a predetermined angle, use of the device will not require time-consuming adjustments which tend to break the shooter's concentration. The improved rail-mirror also eliminates the need for a player to purchase, use, or keep track of additional special tools. The optimum angle for positioning the reflective surface of a rail-mirror which is to be used under the side-rail-cushion of a standard pool table is 9° relative to vertical, away from the playing surface. For rail-mirrors which are to be used under the end-rail-cushion of a standard pool table, the optimum angle is 7° relative to vertical, away from the playing surface. The optimum angle will vary for tables which do not have the same playing surface dimensions as a standard pool table.

The device is not permanently attached to the table, so that the player has the option of playing with or without the device. Additionally, the base is constructed from a lightweight material to improve portability. The preferred material for the base is either aluminum or plastic. The base of the rail-mirror can also be provided with a gripping means for securing the device under the cushion to prevent the device from being inadvertently knocked out of horizontal alignment with the rail cushion. The gripping means may comprise a rail-mirror base having a surface which is knurled, barbed or otherwise roughened.

Accordingly, it is a principal object of the invention to provide an adjustment-free pool table rail-mirror which can be used by a player to line up bank shots while standing in a natural shooting position.

It is a further object of the invention is to provide a lightweight pool table rail-mirror which is not prone to movement resulting from vibration or jarring of the pool table.

It is still another object of the invention to provide a pool table rail-mirror which is portable and not attached to the table, and may be used on any standard pool table, billiard table or snooker table.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
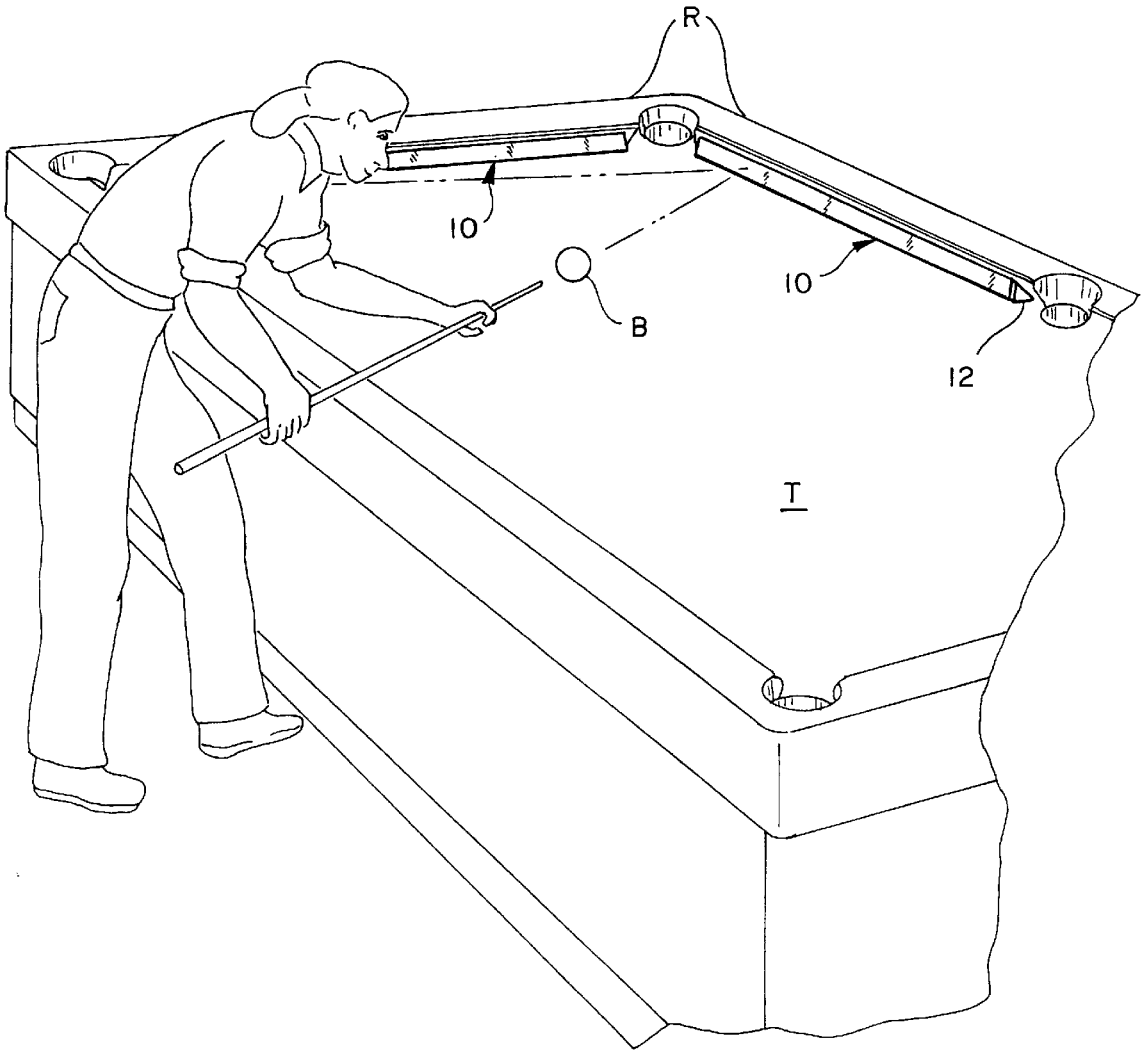
FIG. 1 is an environmental view of a pool table and a player utilizing the rail-mirror according to the present invention to line up a bank shot.

The present invention is an apparatus for teaching pool players to bank shots properly. Referring to the drawings, a rail-mirror 10 according to the present invention, comprises an extruded base 12, preferably having a bottom base-surface 14 which rests on the surface of table T and a rear base-surface 16 which extends upward at an acute angle, and an elongated reflective surface 20 such as a mirror disposed on base 12. The entire rail-mirror 10 fits under and extends in horizontal alignment with rail cushion R of table T.

Figure 3:
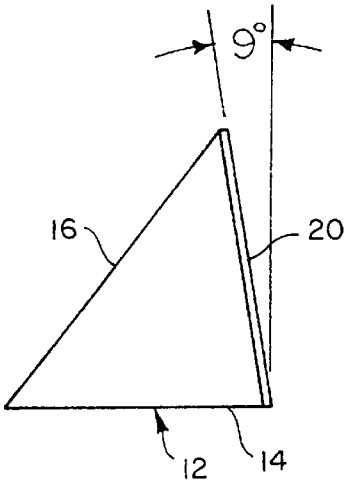
FIG. 3 is a side view of rail-mirror showing the preferred angle relative to vertical of a side-rail-mirror, illustrating an alternative solid base design.
Figure 4:
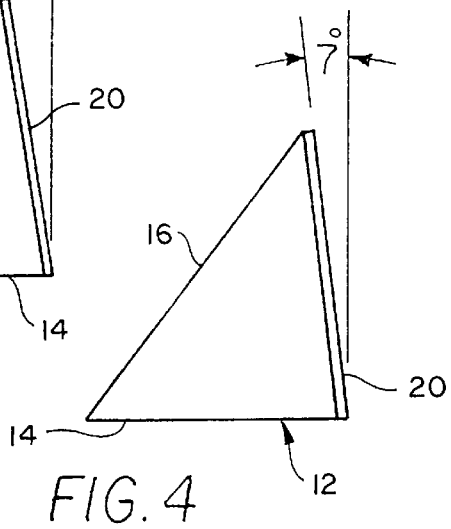
FIG. 4 is a side view of rail-mirror showing the preferred angle relative to vertical of an end-rail-mirror.
Figure 5:
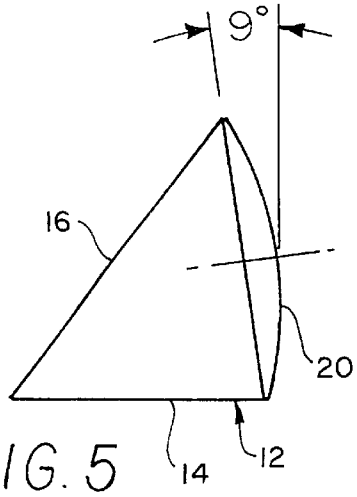
FIG. 5 is a side view of the invention illustrating an embodiment of the invention which utilizes a convex reflective surface instead of a flat surface.

Reflective surface 20 is permanently angled away from the playing surface of table T relative to vertical, thereby reflecting the view of a target, such as a ball B or a table pocket, to the sight-line of a player positioned across table T. Referring to FIGS. 3 and 5, reflective surface 20 of rail-mirror 10 is fixedly angled at approximately 9° relative to vertical, away from the playing surface of pool table T for positioning under side-rail cushion R. Referring to FIG. 4, the reflective surface 20 of the rail-mirrors is fixedly angled at approximately 7° relative to vertical, away from the playing surface of pool table T for positioning under end-rail cushion R.

Figure 6:
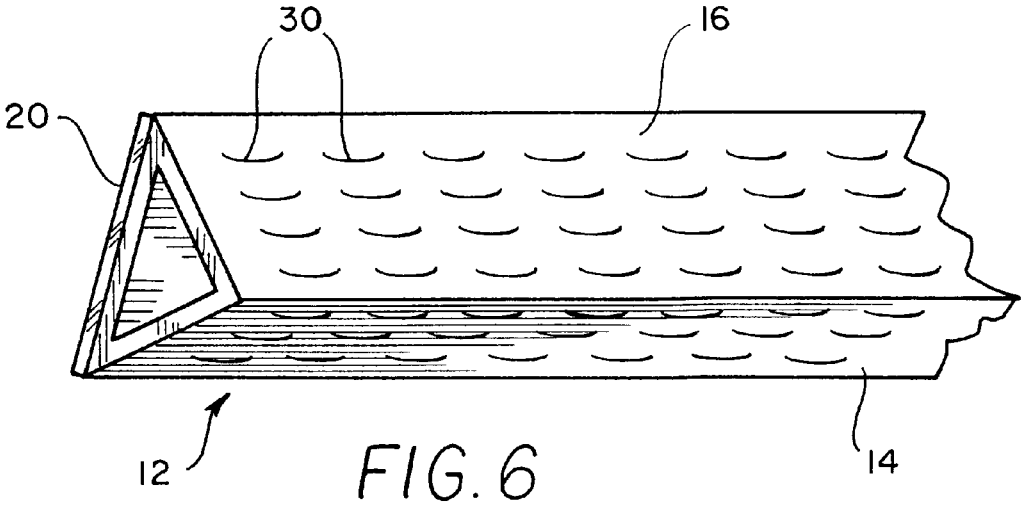
FIG. 6 is a rear-bottom perspective view of the rail-mirror showing the knurled surface of the invention's base for gripping the felt and securing the rail-mirror under the rail cushion.
Figure 7:
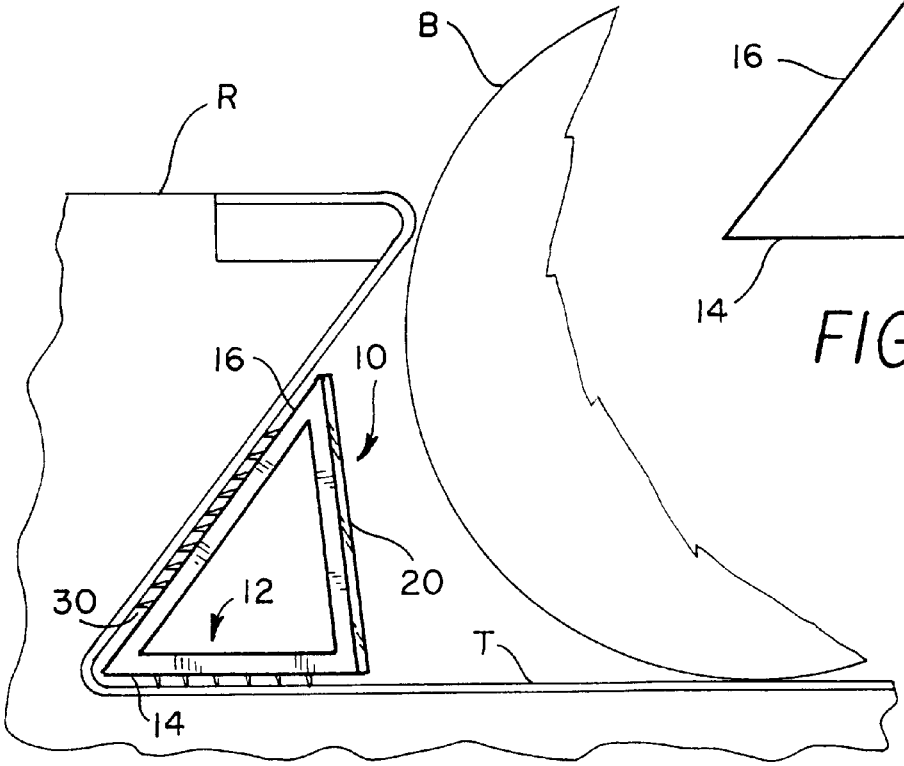
FIG. 7 is a side view of a rail-mirror positioned under a rail cushion and adjacent to a billiard ball, and illustrating the knurled surface of the base.
Figure 8:
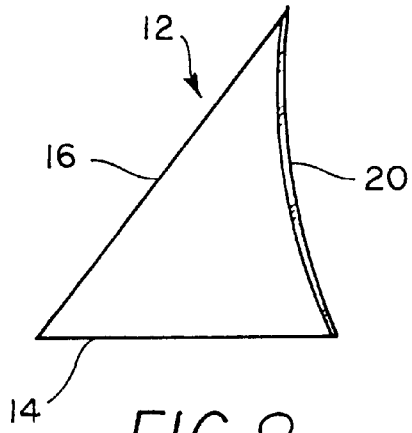
FIG. 8 is a side view of the invention illustrating an embodiment of the invention which utilizes a concave reflective surface instead of a flat surface.

FIGS. 2, 3, 4, 6 and 7 show an embodiment of rail-mirror 10 in which reflective surface 20 is flat. FIG. 5 shows an alternate embodiment of rail-mirror 10 in which reflective surface 20 is convex for enhancing the range of sighting positions from which the reflection of the target may be viewed, and FIG. 8 shows a concave reflective surface 20 for a similar purpose.

Figure 2:
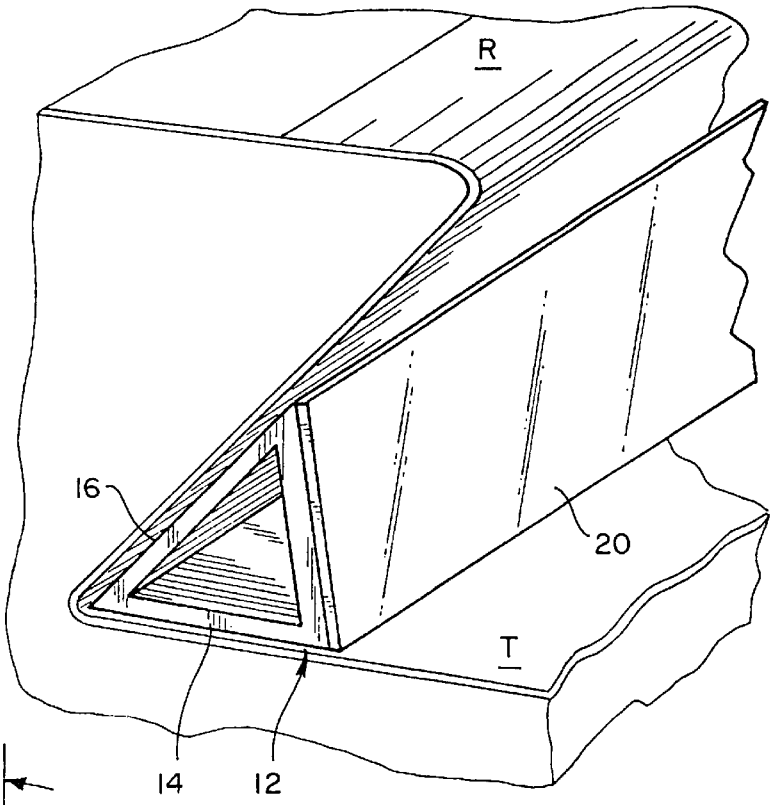
FIG. 2 is an fragmented perspective view of the rail-mirror situated under the pool table cushion, illustrating an embodiment of the invention utilizing a hollow base design.

Base 12 may be of any design which permanently supports reflective surface 20 in accordance with the angular requirements set forth above. FIGS. 2, 6 and 7 set forth an embodiment of the invention wherein base 12 is hollow. FIGS. 3 through 5 and FIG. 8 set forth an embodiment of the invention wherein base 12 is solid.

Referring to FIGS. 6 and 7, base 12 may also be provided with a gripping means 30 for securing the device to the pool table T. The preferred embodiment of the gripping means includes a base 12 having knurls 30 on bottom base-surface 14 and rear base-surface 16.

It is to be understood that the present invention is not limited to the sole embodiment described above, but encompasses any and all embodiments within the scope of the following claims.

I claim:

1. A pool table rail-mirror comprising:

a base having a bottom base-surface for resting on a playing surface of a pool table and a rear base-surface, the base for fitting under and extending along a side-rail cushion and an end-rail cushion of the pool table;

gripping means disposed on the base-surfaces for removably securing the base to the pool table; and a reflective surface fixedly attached to the base to define a triangular shape in cross section, the reflective surface being permanently angled at approximately 9° relative to vertical away from the playing surface of the pool table when positioned under the side-rail cushion and at approximately 7° relative to vertical away from the playing surface when placed under an end-rail cushion.

2. The pool table rail-mirror according to claim 1, wherein the reflective surface is flat.

3. The pool table rail-mirror according to claim 1, wherein the reflective surface is convex.

4. The pool table rail-mirror according to claim 1, wherein the reflective surface is concave.

5. The pool table rail-mirror according to claim 1, wherein the gripping means comprises knurls.

6. The pool table rail-mirror according to claim 1, wherein the base is constructed from a material selected from the group consisting of aluminum and plastic.

* * * * *